US012163519B2

(12) United States Patent
Goss et al.

(10) Patent No.: US 12,163,519 B2
(45) Date of Patent: Dec. 10, 2024

(54) INTERNAL GEAR FLUID MACHINE WITH CONNECTION CHANNEL IN EACH OF TWO HOUSING WALLS

(71) Applicant: ECKERLE TECHNOLOGIES GMBH, Malsch (DE)

(72) Inventors: Alexander Goss, Karlsruhe (DE); Reinhard Pippes, Bretten-Sprantal (DE)

(73) Assignee: ECKERLE TECHNOLOGIES GMBH, Malsch (DE)

( * ) Notice: Subject to any disclaimer, the term of this patent is extended or adjusted under 35 U.S.C. 154(b) by 0 days.

(21) Appl. No.: 18/017,181

(22) PCT Filed: Jul. 19, 2021

(86) PCT No.: PCT/EP2021/070138
§ 371 (c)(1),
(2) Date: Jan. 20, 2023

(87) PCT Pub. No.: WO2022/018023
PCT Pub. Date: Jan. 27, 2022

(65) Prior Publication Data

US 2023/0287883 A1 Sep. 14, 2023

(30) Foreign Application Priority Data

Jul. 24, 2020 (DE) ..... 10 2020 209 406.3

(51) Int. Cl.
*F04C 2/10* (2006.01)
*F04C 14/04* (2006.01)
(Continued)

(52) U.S. Cl.
CPC ..... *F04C 2/101* (2013.01); *F04C 15/0019* (2013.01); *F04C 15/003* (2013.01);
(Continued)

(58) Field of Classification Search
CPC ..... F04C 2/101; F04C 2/102; F04C 15/0019; F04C 15/003; F04C 15/06; F04C 14/04; F04C 2240/54
See application file for complete search history.

(56) References Cited

U.S. PATENT DOCUMENTS 3,597,129 A * 8/1971 Crowther ..... F04C 2/101 418/126
3,824,041 A 7/1974 Rystrom
(Continued)

FOREIGN PATENT DOCUMENTS

CH 439983 A 7/1967
CN 103339381 A 10/2013
(Continued)

OTHER PUBLICATIONS

Foreign patent and machine translation for German Patent DE 44 21 255 C1, Inventor: Eckerle; Title: Packing Pieceless Inner Gearwheel Pump; Published: Jun. 17, 1994. (Year: 1994).*
(Continued)

*Primary Examiner* — Mary A Davis
(74) *Attorney, Agent, or Firm* — Harness, Dickey & Pierce, P.L.C.; Stephen T. Olson

(57) ABSTRACT

An internal gear fluid machine includes a first gearwheel having an external toothing and mounted rotatably about a first axis of rotation, and a second gearwheel having an internal toothing meshing in regions with the external toothing in an engagement region and mounted rotatably about a second axis of rotation different from the first axis of rotation. The internal gear fluid machine additionally includes a filler piece arranged between the first gearwheel and the second gearwheel away from the engagement region, which filler piece bears on one side against the external toothing and on the other side against the internal toothing, in order to divide a fluid space present between the
(Continued)

Figure 1:
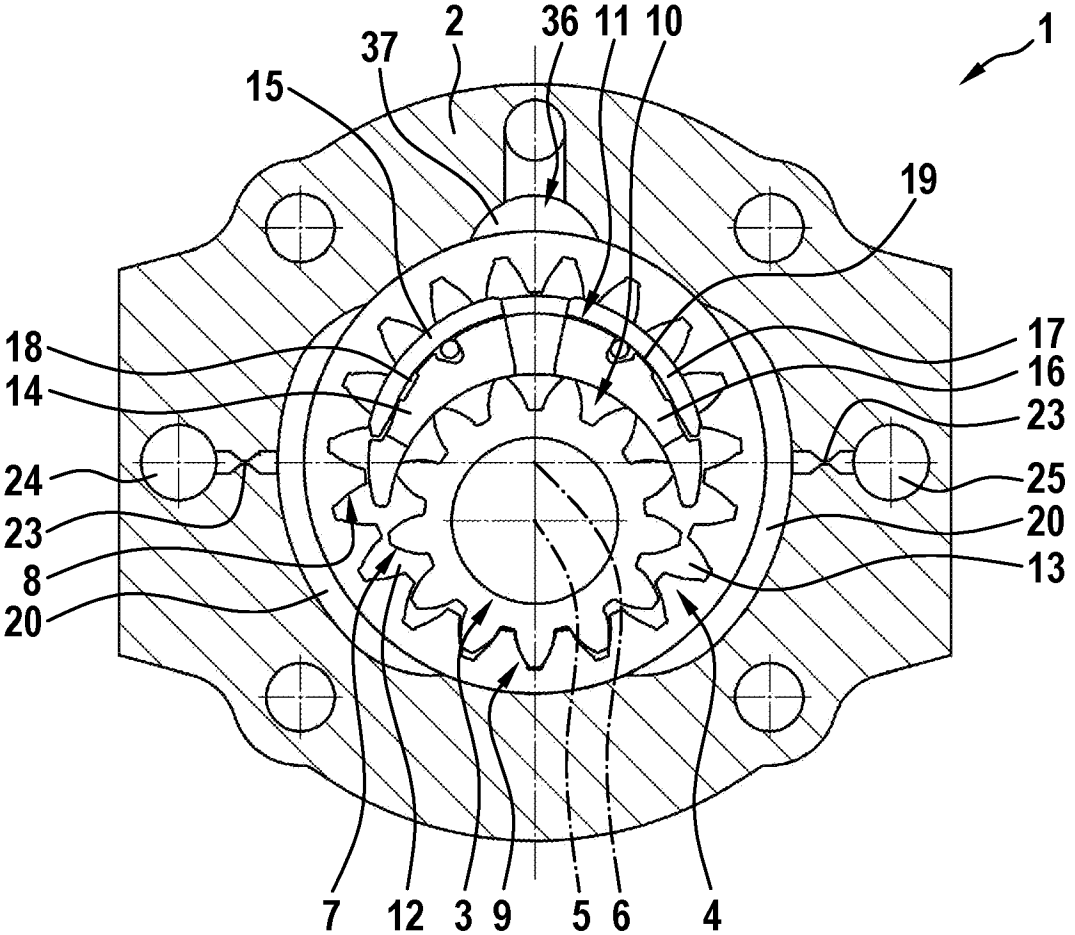

first gearwheel and the second gearwheel into a first fluid chamber and a second fluid chamber. Sealing discs are arranged in the axial direction with respect to the first axis of rotation on both sides of the first gearwheel and the second gearwheel, which, during operation of the internal gear fluid machine, bear in a sealing manner against the first gearwheel and the second gearwheel, and an axial opening is formed in each of the sealing discs. A common one of the fluid chambers is in flow communication with the same fluid connection of the internal gear fluid machine via both axial openings.

10 Claims, 4 Drawing Sheets

(51) Int. Cl.
*F04C 15/00* (2006.01)
*F04C 15/06* (2006.01)

(52) U.S. Cl.
CPC ..... *F04C 15/06* (2013.01); *F04C 14/04* (2013.01); *F04C 2240/54* (2013.01)

(56) References Cited

U.S. PATENT DOCUMENTS

| | | | |
|---|---|---|---|
| 4,214,652 | A | 7/1980 | Quenneville |
| 6,659,748 | B1 | 12/2003 | Arbogast et al. |
| 2014/0030131 | A1 | 1/2014 | Schepp et al. |
| 2023/0296093 | A1 | 9/2023 | Goss |

FOREIGN PATENT DOCUMENTS

| | | | |
|---|---|---|---|
| CN | 203560091 | U | 4/2014 |
| CN | 103850930 | A | 6/2014 |
| CN | 116917623 | A | 10/2023 |
| DE | 7538960 | U | 6/1977 |
| DE | 2547994 | C2 | 7/1985 |
| DE | 19930911 | C1 | 7/2000 |
| DE | 102009024216 | A1 | 12/2009 |
| DE | 102008053318 | A1 | 4/2010 |
| DE | 102011100105 | A1 | 10/2012 |
| DE | 102011075415 | A1 | 11/2012 |
| DE | 102012221953 | A1 | 6/2014 |
| DE | 102018008905 | A1 | 5/2020 |
| EP | 0012015 | A1 | 6/1980 |
| JP | S54-152209 | A | 11/1979 |
| JP | 2017-101796 | A | 6/2017 |
| WO | WO-2010-095505 | A1 | 8/2010 |

OTHER PUBLICATIONS

Foreign patent and machine translation for WIPO Patent Publication WO 2010/095505 A1, Inventor: Masakazu; Title: Internal Gear Pump; Published: Aug. 26, 2010. (Year: 2010).*

International Preliminary Report on Patentability issued in PCT/EP2021/070138, mailed Feb. 2, 2023.

International Search Report (English and German) and Written Opinion of the International Searching Authority (German) issued in PCT/EP2021/070136, mailed Oct. 22, 2021; ISA/EP.

International Preliminary Report on Patentability issued in PCT/EP2021/070136, mailed Feb. 2, 2023.

International Search Report (English and German) and Written Opinion of the International Searching Authority (German) issued in PCT/EP2021/070138, mailed Oct. 29, 2021; ISA/EP.

First Office Action Received in CN202180065829.8, dated Jul. 8, 2024.

* cited by examiner

INTERNAL GEAR FLUID MACHINE WITH CONNECTION CHANNEL IN EACH OF TWO HOUSING WALLS

CROSS REFERENCE TO RELATED APPLICATIONS

This application is a U.S. National Phase Application under 35 U.S.C. 371 of International Application No. PCT/EP2021/070138, filed on Jul. 19, 2021, which claims priority to German Patent Application No. 10 2020 209 406.3, filed on Jul. 24, 2020. The entire disclosures of the above applications are expressly incorporated by reference herein.

The invention relates to an internal gear fluid machine having a first gearwheel which has external toothing and is mounted rotatably about a first axis of rotation, and a second gearwheel which has internal toothing which meshes in regions with the external toothing in an engagement region and is mounted rotatably about a second axis of rotation different from the first axis of rotation, a filler piece being arranged between the first gearwheel and the second gearwheel away from the engagement region, which, on the one hand, bears against the external toothing and, on the other hand, bears against the internal toothing, in order to divide a fluid space present between the first gearwheel and the second gearwheel into a first fluid chamber and a second fluid chamber, and wherein, in the axial direction with respect to the first axis of rotation, housing walls of a machine housing of the internal gear fluid machine are arranged on both sides of the first gearwheel and of the second gearwheel.

For example, DE 199 30 911 C1 is known from the prior art. This describes an internal gear fluid machine for reversing operation in a closed circuit; with an externally toothed pinion; with an internally toothed ring gear which meshes with the pinion; with a housing; with a filling which fills the crescent-shaped space between pinion and ring gear; the filling comprises two identical filling pieces; a stop pin is provided which is mounted in the housing and against which the filling pieces are supported with their end faces. Axial discs are provided on both sides of the pinion. An axial pressure field is provided between the outside of each axial disc and the respective housing wall, and a control field is provided between the inside of each axial disc and the pinion. At least one control slot is connected to each control field, which tapers towards its free end.

Furthermore, DE 10 2008 053 318 A1 discloses a reversibly operable gear machine comprising a housing in which two gears are arranged. A first bearing chamber and a second bearing chamber are provided, wherein in a first operating direction of the gear machine the first bearing chamber and in an opposite second operating direction the second bearing chamber is subjected to a hydraulic fluid pressure and forms a hydrostatic bearing for a gear. Furthermore, a vehicle steering system is described comprising a hydraulic circuit, a hydraulic cylinder and a gear machine which operates as a pump and applies hydraulic pressure to a first working chamber in its first operating direction and to a second working chamber of the hydraulic cylinder in its second operating direction.

It is the objective of the invention to propose an internal gear fluid machine which has advantages over known internal gear fluid machines, in particular enabling a higher efficiency due to a more uniform filling of the fluid chamber with fluid.

According to the invention, this is achieved with an internal gear fluid machine comprising: a first gearwheel having an external toothing and mounted rotatably about a first axis of rotation, and a second gearwheel having an internal toothing meshing in regions with the external toothing in an engagement region and mounted rotatably about a second axis of rotation different from the first axis of rotation; a filler piece arranged between the first gearwheel and the second gearwheel away from the engagement region, the filler piece bearing on a first side against the external toothing and bearing on a second side against the internal toothing in order to divide a fluid space present between the first gearwheel and the second gearwheel into a first fluid chamber and a second fluid chamber; and a connection channel formed in each of two housing walls of a machine housing of the internal gear fluid machine, the housing walls arranged in an axial direction with respect to the first axis of rotation on both sides of the first gearwheel and the second gearwheel, wherein at least one of the first and second fluid chambers are in flow connection with the internal gear fluid machine via both of the connection channels.

The internal gear fluid machine is a fluid conveying device and is used to convey a fluid, for example a liquid or a gas. For this purpose, the internal gear fluid machine has two gearwheels, namely the first gearwheel and the second gearwheel. The first gearwheel can also be called a pinion and the second gearwheel a ring gear. The pinion gear has the external toothing and the ring gear has the internal toothing. The external toothing and the internal toothing engage with each other in the circumferential direction, i.e. they mesh with each other in the engagement region. The two gearwheels are provided for conveying fluid and for this reason are designed in such a way that they cooperate with each other during a rotary movement for conveying the fluid and in doing so engage or mesh with each other.

The first gearwheel is preferably coupled to an input shaft or drive shaft of the internal gear fluid machine, preferably rigidly and/or detachably or permanently. In the case of detachable coupling, for example, there is a plug-in pinion which is plugged onto the drive shaft and can be detached from it without damage. Preferably, the plug-in pinion has an internal toothing which cooperates with an external toothing of the input shaft for drive coupling of the plug-in pinion with the input shaft. For example, the first gearwheel is rotatably mounted in a machine housing of the internal gear fluid machine by means of the input shaft. Preferably, the first gearwheel is arranged on the input shaft so that it always has the same speed as the input shaft during operation of the internal gear fluid machine.

Both the first gearwheel and the second gearwheel are arranged in the machine housing and rotatably mounted in it. The first gearwheel is rotatably mounted around the first axis of rotation, whereas the second gearwheel is rotatably mounted around the second axis of rotation. The first axis of rotation can also be referred to as the pinion axis of rotation and the second axis of rotation as the ring gear axis of rotation. Seen in cross-section, i.e. in a sectional plane perpendicular to the axes of rotation, the first gearwheel is arranged in the second gearwheel, namely in such a way that the external toothing of the first gearwheel meshes or engages with the internal toothing of the second gearwheel in the engagement region. This means that a rotational movement of the first gearwheel is directly transmitted to the second gearwheel and, conversely, a rotational movement of the second gear is directly transmitted to the first gear.

The engagement area is arranged fixed to the housing, for example, so it does not rotate with the first gearwheel or the second gearwheel. In the engagement region, a tooth of one of the toothings engages in a tooth space of the other of the toothings. The tooth space is bounded in the circumferential direction by teeth of the respective toothing. For example, a tooth of the internal toothing engages in a tooth space of the external toothing or, conversely, a tooth of the external toothing engages in a tooth space of the internal toothing. In the engagement region, the internal toothing and the external toothing interact in a sealing manner.

On the other side of the engagement region, i.e. preferably on the diametrically opposite side of the engagement region with respect to the first axis of rotation and/or the second axis of rotation, the filler piece is arranged. The filler piece is located between the first gearwheel and the second gearwheel or, in other words, between the external toothing of the first gearwheel and the internal toothing of the second gearwheel. The filler piece is thus arranged in a fluid space which is bounded radially inwards by the first gearwheel and radially outwards by the second gearwheel, in relation to the first axis of rotation and the second axis of rotation respectively.

The filler piece lies on the one hand against the external toothing and on the other hand against the internal toothing. More precisely, the filler piece lies in sealing contact with tooth tips of the external toothing and in sealing contact with tooth heads of the internal toothing in order to divide the fluid space into the first fluid chamber and the second fluid chamber. Each of the two fluid chambers is thus bounded in the circumferential direction on the one hand by the filler piece and on the other hand by the sealing interlocking of the external teeth and the internal teeth in the engagement region.

Depending on the direction of rotation of the internal gear fluid machine, one of the fluid chambers serves as the suction chamber and the other of the fluid chambers serves as the pressure chamber. If the internal gear fluid machine is designed as a pump or is operated as a pump, fluid is supplied to the respective suction chamber, which is conveyed by the internal gear fluid machine in the direction of the pressure chamber or into the pressure chamber. If, on the other hand, the internal gear fluid machine is designed as a motor or is operated as a motor, fluid is supplied to the pressure chamber which enters the suction chamber under the effect of a rotary movement of the gear wheels. In the context of this description, the operation of the internal gear fluid machine as a motor is not explicitly discussed, but the internal gear fluid machine and its function are explained for operation as a pump. However, it is of course always possible to use the internal gear fluid machine as a motor and the explanations can be applied analogously to such a design of the internal gear fluid machine or such a use.

Preferably, the filling piece is made of several parts and thus has several segments. The segments of the filling piece are arranged next to each other in the radial direction, so that a first segment is arranged on the side of a second segment facing the first gearwheel and, conversely, the second segment is arranged on the side of the first segment facing the second gearwheel. The first segment is in sealing contact with the first gearwheel or its external toothing and the second segment is in sealing contact with the second gearwheel or the internal toothing of the second gearwheel.

The two segments are preferably displaceable relative to each other in the radial direction. Particularly preferably, a gap between them is subjected to fluid pressure during operation of the internal gear fluid machine in such a way that the first segment is forced in the direction of the first gearwheel and the second segment in the direction of the second gearwheel, so that the segments are in sealing contact with the respective gearwheel or the tooth heads of the corresponding toothing. The internal gear fluid machine is thus radially compensated or gap compensated in the radial direction. Each of the segments can be further subdivided into segments. For example, the first segment is in one piece or consists of at least two segments and/or the second segment is in one piece or consists of at least two segments. These segments of the filling piece are also preferably displaceable mounted so that they can be displaced in relation to each other, i.e. they can be displaced independently of each other. This achieves a particularly effective gap compensation.

The internal gear fluid machine has the machine housing. The two gearwheels of the internal gear fluid machine are arranged between housing walls of the machine housing. Thus, one of the housing walls is present on a first side of the gearwheels and a second of the housing walls is present on a side of the gearwheels opposite to the first side in the axial direction, such that the housing walls receive the gearwheels between them when viewed in the axial direction. In particular, a gap remaining between the housing walls and the gearwheels is dimensioned so small that the housing walls provide sufficient sealing of the fluid space or fluid chambers. For example, the gearwheels are mounted on and/or in the machine housing.

A connection channel is formed in each of the housing walls. This means that each of the housing walls has such a connection channel. One of the fluid chambers is fluidically connected, preferably permanently, to a fluid connection of the internal gear fluid machine via the connection channels. From a fluidic point of view, each of the connection channels is therefore located between this fluid chamber and this fluid connection, so that the flow connection between the fluid chamber and the fluid connection runs via both connection channels. The connection channels are fluidically parallel between the fluid chamber and the fluid connection, so that fluid can flow via both connection channels simultaneously from the fluid connection to the fluid chamber or vice versa.

It is therefore not intended to connect different fluid chambers with the same fluid connection or one of the fluid chambers with different fluid connections via the connection channels. Rather, the connection channels serve to establish the flow connection between exactly one of the fluid chambers and exactly one of the fluid connections. Accordingly, during operation of the internal gear fluid machine, the fluid flows simultaneously either out or in through the connection channels. In this way, a particularly high fluid throughput of the internal gear fluid machine can be achieved. Moreover, the flow connection is to be understood as a flow connection that runs exclusively via the internal gear fluid machine, i.e. not via an external connection. In particular, the flow connection runs only via the connection channels and—optionally—via one or more axial openings in one or more optionally provided sealing discs.

In principle, it may be provided that the fluid chamber, which is fluidically connected to the fluid connection via the connection channels, is the first fluid chamber or the second fluid chamber. Accordingly, the fluid chamber can be either the suction chamber or the pressure chamber, so that during operation of the internal gear fluid machine, the connection channels serve either to feed fluid into the suction chamber or to discharge fluid from the pressure chamber. In either case, a particularly low flow resistance is achieved when the fluid flows in or out.

A further development of the invention provides that at least one sealing disc is arranged next to the first gearwheel and the second gearwheel in the axial direction with respect to the first axis of rotation, which sealing disc is in sealing contact with the first gearwheel and the second gearwheel during operation of the internal gear fluid machine, wherein an axial opening is formed in the sealing disc, via which one of the fluid chambers is in flow communication with one of the fluid connections of the internal gear fluid machine. For example, seen in the axial direction, the sealing disc is only present on one side of the first gearwheel and the second gearwheel. Preferably, however, it is provided that—again seen in axial direction—such a sealing disc is arranged on both sides of each of the two gearwheels. In the context of this description, the particularly advantageous case of having several sealing discs is often explained. However, it goes without saying that the corresponding explanations can also be used for a design of the internal gear fluid machine in which only one sealing disc is part of the internal gear fluid machine.

The sealing disc is located on one side of the gearwheels, seen in axial direction. During operation of the internal gear fluid machine, the sealing disc is in sealing contact with the gearwheels. For this purpose, it is preferably pressed in the axial direction towards the gearwheels, for example by pressurisation, i.e. by the application of a pressurised fluid. If there are several sealing discs, they are arranged on both sides of the gearwheels in the axial direction. One of the sealing discs is therefore on a first side of the gearwheels and a second of the sealing discs is on a second side of the gearwheels opposite the first side in the axial direction, so that the sealing discs receive the gearwheels between them as seen in the axial direction. During operation of the internal gear fluid machine, the sealing discs are in sealing contact with the gearwheels. For this purpose, they are preferably pressed in the axial direction towards the gearwheels, for example by pressurisation, i.e. by the application of a pressurised fluid. The internal gear fluid machine is thus axially compensated or gap compensated in the axial direction. This achieves a particularly high efficiency of the internal gear fluid machine.

The axial opening is formed in the sealing disc. If there are several sealing discs, an axial opening is formed in each of the sealing discs. In other words, each of the sealing discs has one such axial opening, so that a total of several axial openings are formed in the several sealing discs. One of the fluid chambers is fluidically connected, preferably permanently, to a fluid connection of the internal gear fluid machine via the axial opening or openings. From a fluidic point of view, the axial opening or each of the axial openings is therefore located between this fluid chamber and this fluid connection, so that the flow connection between the fluid chamber and the fluid connection runs via the axial opening or both axial openings.

It is therefore not intended to connect different fluid chambers to the same fluid connection via the axial opening(s) or to connect one of the fluid chambers to different fluid connections. Rather, the axial opening or the axial openings serve to establish the flow connection between exactly one of the fluid chambers and exactly one of the fluid connections. Accordingly, during operation of the internal gear fluid machine, the fluid flows either out or in through the axial opening or simultaneously through the axial openings. This makes it possible to achieve a particularly high fluid throughput of the internal gear fluid machine.

In principle, it may be provided that the fluid chamber, which is fluidically connected to the fluid connection via the axial opening or openings, is the first fluid chamber or the second fluid chamber. Accordingly, the fluid chamber can be either the suction chamber or the pressure chamber, so that during operation of the internal gear fluid machine, the axial opening or openings serve either to feed fluid into the suction chamber or to discharge fluid from the pressure chamber. In either case, a particularly low flow resistance is achieved when the fluid flows in or out.

A further development of the invention provides that at least one of the connection channels is fluidically connected to the fluid chamber via the axial opening. In other words, the axial opening is fluidically located between the connection channel and the fluid chamber. Accordingly, the fluid chamber is fluidically connected to the fluid connection via the axial opening and the corresponding connection channel. Particularly preferably, of course, both connection channels are fluidically connected to the fluid chamber via the axial openings. This means that a first of the connection channels is fluidically connected to the fluid chamber via a first of the axial openings. In addition, a second of the connection channels is in fluidic connection with the same fluid chamber via a second of the axial openings. In total, therefore, there are several flow paths between the fluid chamber and the fluid connection, a first of the flow paths running via the first axial opening and the first connection channel and a second of the flow paths running via the second axial opening and the second connection channel.

A further development of the invention provides that the axial opening widens in the direction of the first gearwheel and the second gearwheel. A flow cross-sectional area of the axial opening does not remain constant over its respective extension, but rather changes. The flow cross-sectional area of the axial opening increases in the direction of the gearwheels, i.e. it becomes larger. For example, the widening takes place continuously, at least in sections or throughout, so that discontinuities in the flow cross-sectional area are avoided. However, the widening can also take place abruptly, so that a dimensional jump is formed in the axial opening. Preferably, the axial opening is round, i.e. circular, in cross-section with respect to its respective longitudinal extension. The widening of the axial opening enables a particularly efficient inflow or outflow of the fluid. Particularly preferably, the widening is carried out for both axial openings. In this respect, it is provided that the axial openings widen in the direction of the first gearwheel and the second gearwheel respectively. The explanations for the widening of the axial aperture can be used as a supplement in each case.

A further development of the invention provides that one of the connection channels is connected to the fluid connection directly and another of the connection channels is connected to the fluid connection via a connection channel overlapping the first gearwheel and the second gearwheel in the axial direction. For example, the connection channels have the same flow cross-sectional area. Preferably, at least one of the connecting channels opens into the axial opening, if present. Particularly preferably, both connection channels open into the optionally available multiple axial openings.

For example, it can be provided that the flow cross-sectional area of the connection channel on its side facing the gearwheels and/or the respective axial opening is smaller than the flow cross-sectional area of the axial opening on its side facing the gearwheels and/or the respective connection channel. From the direction of the connection channel in the direction of the gearwheels and/or the axial openings, the flow cross-section is widened and the flow cross-sectional area is correspondingly enlarged.

It can be provided that the connection channels have the same longitudinal extension in the axial direction with respect to their respective longitudinal centre axis. One of the connection channels is directly connected to the fluid connection in terms of flow, for example it opens directly into the fluid connection. The other of the connection channels is only indirectly connected to the fluid connection in terms of flow via the connection channel. The connecting channel completely overlaps the two gearwheels in the axial direction.

In addition, it may be provided that the connecting channel overlaps at least one sealing disc or both sealing discs, if these are present. It is thus provided, for example, that the connecting channel opens into the connecting channel on a side of a first of the sealing discs facing away from the gearwheels and into the fluid connection on a side of another of the sealing discs facing away from the gearwheels. For example, one connection channel opens into the fluid connection in the axial direction and the other connection channel opens into the fluid connection in the radial direction.

The fluid connection has a flow cross-sectional area that is larger than the flow cross-sectional area of the connection channels. For example, the flow cross-sectional area of the fluid connection is larger than the flow cross-sectional area of the connection channels by a factor of at least 2.5, at least 3, at least 4 or at least 5. Additionally or alternatively, the flow cross-sectional area of the connection channel is larger than the flow cross-sectional area of the connection channels, for example by a factor of at least 1.25, at least 1.5, at least 1.75 or at least 2.0. This ensures particularly effective operation of the internal gear fluid machine.

A further development of the invention provides that the axial opening is surrounded by a seal, which is in sealing contact on the one hand with the sealing disc and on the other hand with the machine housing, wherein a pressure field connected in terms of flow to a pressure side of the internal gear fluid machine is formed outside a region surrounded by the seal, so that the sealing disc is at least temporarily forced in the direction of the gearwheels. The seal ensures a fluid-tight connection between the axial opening or the respective axial opening and the respective connecting channel.

Away from the seal, i.e. outside the area enclosed by the seal, into which the axial opening and the connection channel open, the pressure field is present, which is at least temporarily subjected to pressurised fluid. For this purpose, the pressure field is fluidically connected to the pressure side of the internal gear fluid machine. The pressurised fluid forces the sealing disc towards the gearwheels so that the fluid chambers are reliably sealed from the axial discs in the axial direction. Particularly preferably, this applies to the multiple sealing discs, if present. It can therefore be provided that the axial openings are each surrounded by a seal which, on the one hand, bears sealingly against the respective sealing disc and, on the other hand, against the machine housing, wherein a pressure field connected in terms of flow to a pressure side of the internal gear fluid machine is formed outside a region surrounded by the seal, so that the sealing disc is at least temporarily forced in the direction of the gearwheels.

A further development of the invention provides that the filler piece extends in the circumferential direction as far as the axial opening and/or, viewed in the circumferential direction, ends in overlapping with the axial opening. The filling piece thus projects in the circumferential direction as far as an imaginary extension of the axial opening. At least it engages in this imaginary extension, but it can also pass completely through it in the circumferential direction. Particularly preferably, however, the filler piece ends, viewed in the circumferential direction, in overlap with the axial opening, i.e. in the imaginary extension of the axial opening. In this way, a reliable and effective sealing of the fluid chambers against each other is achieved by means of the filling piece. It should also be noted at this point that such a design preferably applies to several axial openings. It is thus provided, for example, that the filling piece projects in the circumferential direction as far as the axial openings and/or, viewed in the circumferential direction, ends in overlapping with the axial openings.

A further development of the invention provides that the filler piece is tapered in overlapping with the axial opening in the axial direction, in particular only on one side or on both sides. It is particularly preferred that the taper of the filling piece ends in overlapping with the axial openings as seen in the circumferential direction. The taper of the filler piece causes the filler piece to move away from the axial opening or at least one of the axial openings in the axial direction, i.e. to be continuous therewith. In other words, the distance between the filler piece and the axial opening or at least one of the axial openings increases in the circumferential direction. This facilitates the inflow or outflow of the fluid.

In addition, the taper of the filler piece can be designed in such a way that the fluid is deflected in an efficient manner in the circumferential direction so that it can flow into or out of the respective fluid chamber particularly efficiently. It can be provided that the filler piece is only tapered on one side, i.e. on its side facing the axial opening or one of the axial openings. However, it is particularly preferred that it is tapered on both sides so that the inflow or outflow through the axial opening or both axial openings can take place efficiently. Particularly preferably, the filler piece is symmetrical when viewed in longitudinal section, i.e. in the axial direction, so that the taper on both sides is identical, although mirror-inverted.

A further development of the invention provides that the taper of the filler piece, viewed in the circumferential direction, ends in overlap with the axial opening or openings. The filler piece extends at least in some areas up to the axial opening or openings and preferably has constant dimensions in the axial direction as seen in the circumferential direction up to the taper. For example, up to the imaginary extension of the axial opening or openings, the filler piece has an extension in the axial direction which corresponds to the distance of the sealing discs from each other, so that it rests against the sealing discs away from the axial opening or openings, in particular continuously in the circumferential direction. Only then, i.e. in overlapping with the axial opening or openings, does the filler piece taper so that its extension in the axial direction decreases in the circumferential direction, namely up to a free end of the filler piece. In other words, the taper only begins when it overlaps with the axial opening or openings and preferably extends to the free end of the filler piece. This ensures a reliable sealing effect of the filler piece.

A further development of the invention provides that the second gearwheel is surrounded in the circumferential direction at least in some areas by at least one bearing recess formed in the machine housing, which in the axial direction only partially engages over the second gearwheel and is fluidically connected to one of the fluid connections, in particular via a flow resistance or a fluid line having a flow resistance. The bearing recess serves to form a hydrostatic bearing for the second gear. During operation of the internal gear fluid machine, the bearing recess is thus at least temporarily pressurised with fluid, so that the second gearwheel is forced away from the machine housing in the radial direction. This creates a fluid film between the second gearwheel and the machine housing, which results in a particularly loss-free bearing of the second gearwheel.

It can be provided that the bearing recess completely surrounds the second gearwheel in the circumferential direction. Preferably, however, it only partially surrounds the second gearwheel in the circumferential direction. Particularly preferably, there are two bearing recesses spaced apart from each other in the circumferential direction, i.e. the two bearing recesses are spaced apart from each other on both sides in the circumferential direction. In particular, the bearing recesses, viewed in cross-section, are arranged symmetrically with respect to an imaginary plane which accommodates the axis of rotation of the first gearwheel and/or the axis of rotation of the second gearwheel. For example, the bearing recesses are fluidically connected to different fluid connections, preferably each via a flow resistor. In other words, a first of the bearing recesses is fluidically connected to a first fluid connection via a first flow resistance and a second of the bearing recesses is fluidically connected to a second fluid connection of the internal gear fluid machine via a second flow resistance.

This means that each of the bearing recesses is directly connected to the corresponding fluid connection via the respective flow resistance and is only indirectly in flow connection with the respective other fluid connection, in particular via the fluid space or one or more of the fluid chambers. Depending on the direction of rotation of the internal gear fluid machine, one of the bearing recesses is always fluidically connected to the pressure side and another of the bearing recesses to the suction side of the internal gear fluid machine. This achieves a balance of forces within the internal gear fluid machine, resulting in particularly high efficiency. The flow resistance is arranged in particular in that fluid line via which the respective bearing recess is in flow connection with the corresponding fluid connection. For example, it is thus provided that the bearing recesses are each connected to the corresponding fluid connection via a fluid line, with a flow resistor being arranged in each of the fluid lines. All explanations relating to the bearing recess within the scope of this description are preferably optionally applicable to each of the plurality of bearing recesses, if present.

In the axial direction, the bearing recess only partially overlaps the second gearwheel, so that the second gearwheel completely overlaps the bearing recess in the axial direction. For example, the bearing recess is bounded in the axial direction on both sides by bearing webs which are formed in the circumferential direction to overlap the bearing recess and have at least the same extension as the bearing recess. In the case of several bearing recesses, each of the bearing recesses has such bearing webs. The second gearwheel lies against the bearing webs in a sealing manner, in particular continuously in the circumferential direction in overlapping with the bearing recess, or the second gearwheel has a smaller distance from the bearing webs than from a base of the bearing recess which bounds the bearing recess in the direction facing away from the second gearwheel, in particular in the radial direction outwards. This reliably prevents an undesired outflow of fluid from the bearing recess. For example, the second gearwheel has a bearing clearance, i.e. a distance in the radial direction from the bearing webs, of at most 0.25 mm, at most 0.2 mm, at most 0.15 mm, at most 0.1 mm, at most 0.075 mm or at most 0.05 mm. Preferred are the distances of at most 0.1 mm and less.

The bearing recess is fluidically connected to a return flow of the internal gear fluid machine, via which fluid is discharged, in particular in the direction of a suction side of the internal gear fluid machine. If there are several bearing recesses, the return flow or at least one return flow recess of the return flow is preferably arranged in the circumferential direction between the bearing recesses. In particular, the bearing recesses are arranged equidistant from the return recess in the circumferential direction. The return recess is a recess formed in the machine housing and open in the direction of the gearwheels. The return recess can have the same dimensions in the axial direction as the at least one bearing recess or the bearing recesses or project beyond them in the axial direction, in particular only on one side or on both sides. The bearing recess or the bearing recesses are each formed at a distance from the return recess in the circumferential direction.

The return flow is thus preferably designed in such a way that the fluid present in it is again fed to the internal gear fluid machine and conveyed by it in the direction of its pressure side. As already explained, the bearing recess is spaced from the return recess in the circumferential direction. However, it can also be provided that the bearing recess, viewed in the circumferential direction, is connected to the return flow or the return flow recess at exactly one point, in particular it opens into the return flow recess. The return or the return recess is centred in relation to the filler piece, for example, as seen in the circumferential direction. This means that it is centrally located between the pressure side and the suction side of the internal gear fluid machine, so that it is ultimately symmetrical.

The bearing recess is fluidically connected to one of the fluid connections in order to pressurise it with the pressurised fluid. Preferably, the flow resistance is present between the fluid connection and the bearing recess, which causes a reduction in pressure. The flow resistance is preferably in the form of a cross-sectional constriction. Preferably, a flow cross-sectional area is from the point of the fluid identical before and after the flow resistance or the cross-sectional constriction. This means that the cross-sectional constriction is only present in sections, in particular it does not extend directly to the bearing recess. Rather, the flow cross-sectional area decreases in the area of the cross-sectional constriction and then increases again, in particular also in the area of the cross-sectional constriction. For example, a ratio between a length and a width or a diameter of the cross-sectional constriction is at most 25, at most 20 or at most 15. Preferably, however, the ratio is at most 10 or at most 5. The width or the diameter is to be understood as the smallest dimension of the cross-sectional constriction over its extension.

By means of the flow resistance, fluid loss from the bearing recess towards the return is reduced. The flow resistance can be provided because usually the pressure of the fluid available on the pressure side of the internal gear fluid machine is more than sufficient to achieve adequate bearing. It is therefore possible to reduce the pressure without degrading the quality of the bearing. The reduction of the pressure in turn causes a reduction of the flow, so that a smaller amount of fluid is discharged via the bearing recess in the direction of the return or into the return.

The flow resistance is designed, for example, as a fluidic orifice plate, fluidic throttle or fluidic nozzle. An orifice plate is understood to be an abrupt cross-sectional constriction, i.e. at the beginning of the orifice plate the flow cross-sectional area is suddenly reduced and at the end of the orifice plate is just as suddenly widened again, in particular to the same flow cross-sectional area as before the orifice plate. For example, the orifice has a ratio of the length of the cross-sectional constriction in the direction of flow to the width or diameter of at most 2, at most 1.5 or at most 1. The same applies to the orifice, with the difference that the ratio of length to width or diameter is greater. In particular, the ratio is at least 2 or greater than 2. For example, a ratio of at least 3, at least 4 or at least 5 is used.

The nozzle is a cross-sectional constriction in which the flow cross-sectional area continuously decreases until it reaches a minimum. Downstream of the minimum flow cross-sectional area, the flow cross-sectional area widens again. This can be suddenly or continuously. In the latter case, the flow resistance has a diffuser in addition to the nozzle. For example, the nozzle and the diffuser are symmetrical or mirror images of each other, i.e. they have the same longitudinal extension and the same gradient of the cross-sectional area of flow over the longitudinal extension. The use of the nozzle and the diffuser enables an effective reduction of the pressure or throughput without excessive losses.

Preferably, the flow resistance is designed in such a way that the quantity of fluid discharged from the bearing recess into the return flow per unit of time corresponds to at most 50%, at most 40%, at most 30% or at most 25% of the total quantity of fluid per unit of time occurring in the return flow. Such a dimensioning of the flow resistance is in any case suitable to realise a sufficient bearing of the second gearwheel in the machine housing. Of course, the amount of fluid per unit of time can also be higher and correspond, for example, to at most 75%, at most 70%, at most 65%, at most 60% or at most 55% of the aforementioned size. However, the smaller values are preferred, because with these the fluid loss can be significantly limited with sufficient quality of the bearing.

For example, dimensions of the flow resistance, in particular a smallest flow cross-sectional area of the flow resistance, are dependent on a diameter of the second gearwheel or a root circle diameter of the internal toothing. It may be provided that the dimensions are selected as a function of an extension of the bearing recess in the circumferential direction and/or in the axial direction. Additionally or alternatively, a dependence on the bearing clearance and/or on an extension of the bearing lands in axial direction may be provided. For example, a relationship with a displacement volume of the internal gear fluid machine is also provided. In particular, a ratio of the dimensions of the flow resistance, in particular of a smallest diameter of the flow resistance over its extension, to the displacement volume of at least 15 $l/m^2$ and at most 75 $l/m^2$, at least 30 $l/m^2$ and at most 60 $l/m^2$ or at least 30 $l/m^2$ and at most 45 $l/m^2$ is provided. This results in dimensions of 0.12 mm to 0.6 mm for an internal gear fluid machine with a displacement volume of 8 $cm^3$. These values apply in particular to a design of the flow resistance as an orifice.

Particularly preferably, the bearing recess is fluidically connected to both fluid connections, in particular in each case via a flow resistance. In this way, the provision of the hydrostatic bearing is achieved independently of a direction of rotation of the internal gear fluid machine and independently of operation as a pump or as a motor. The flow resistance is identical for both fluid connections. Alternatively, however, an asymmetrical design can be realised, in which different flow resistances are present between the fluid connections and the bearing recess.

A further development of the invention provides that the fluid connection is a first fluid connection of several fluid connections and that the first fluid chamber is in flow connection with the fluid connection present as the first fluid connection via the connection channels present as first connection channels, and that a second connection channel is formed in each of the housing walls and the second fluid chamber is in flow connection with a second fluid connection of the internal gear fluid machine via the second connection channels. Overall, the internal gear fluid machine therefore has several fluid connections, several first connection channels and several second connection channels. The aforementioned fluid connection forms the first fluid connection and the aforementioned connection channels form the first connection channels.

In addition to the first fluid connection, the second fluid connection and in addition to the first connection channels, the second connection channels are now present in the machine housing. Via the second connection channels, the second fluid chamber is fluidically connected to the second fluid connection, preferably permanently. The further explanations in the context of this description with regard to the first connection ducts can be applied analogously to the second connection ducts.

It is particularly preferred that the filler piece extends in the circumferential direction from the first connection channels to the second connection channels, i.e. that it engages both in the imaginary extension of the first connection channels and in the imaginary extension of the second connection channels. Furthermore, the described taper is particularly preferably provided and formed both on the side of the filler piece facing the first connection channels and on the side facing the second connection channels. The described design enables in particular a direction-independent operation of the internal gear fluid machine.

In addition or alternatively, the foregoing applies to the connection channels for the axial opening or openings. It can thus be provided that the fluid connection is a first fluid connection of several fluid connections and that the first fluid chamber is in flow connection with the fluid connection present as the first fluid connection via the axial opening formed as the first axial opening, and that a second axial opening is formed in the sealing disc and the second fluid chamber is in flow connection with a second fluid connection of the internal gear fluid machine via the second axial opening. Particularly preferably, of course, there are again several sealing discs with correspondingly several axial openings, the axial openings being formed as first axial openings. In such a design, a second axial opening is formed in each of the sealing discs, whereby the second fluid chamber is in flow connection with the second fluid connection via the second axial openings.

A further development of the invention provides that the filler piece is symmetrical in the circumferential direction so that the internal gear fluid machine is reversible. This means that the filler piece is divided into several segments in the circumferential direction. Particularly preferably, the filler piece has a total of four segments, since it is divided into individual segments both in the radial direction and in the circumferential direction. In this way, the radial compensation of the internal gear fluid machine is realised independently of its direction of rotation. Such an internal gear fluid machine can also be called a four-quadrant internal gear fluid machine or a reversible internal gear fluid machine.

Figure 2:
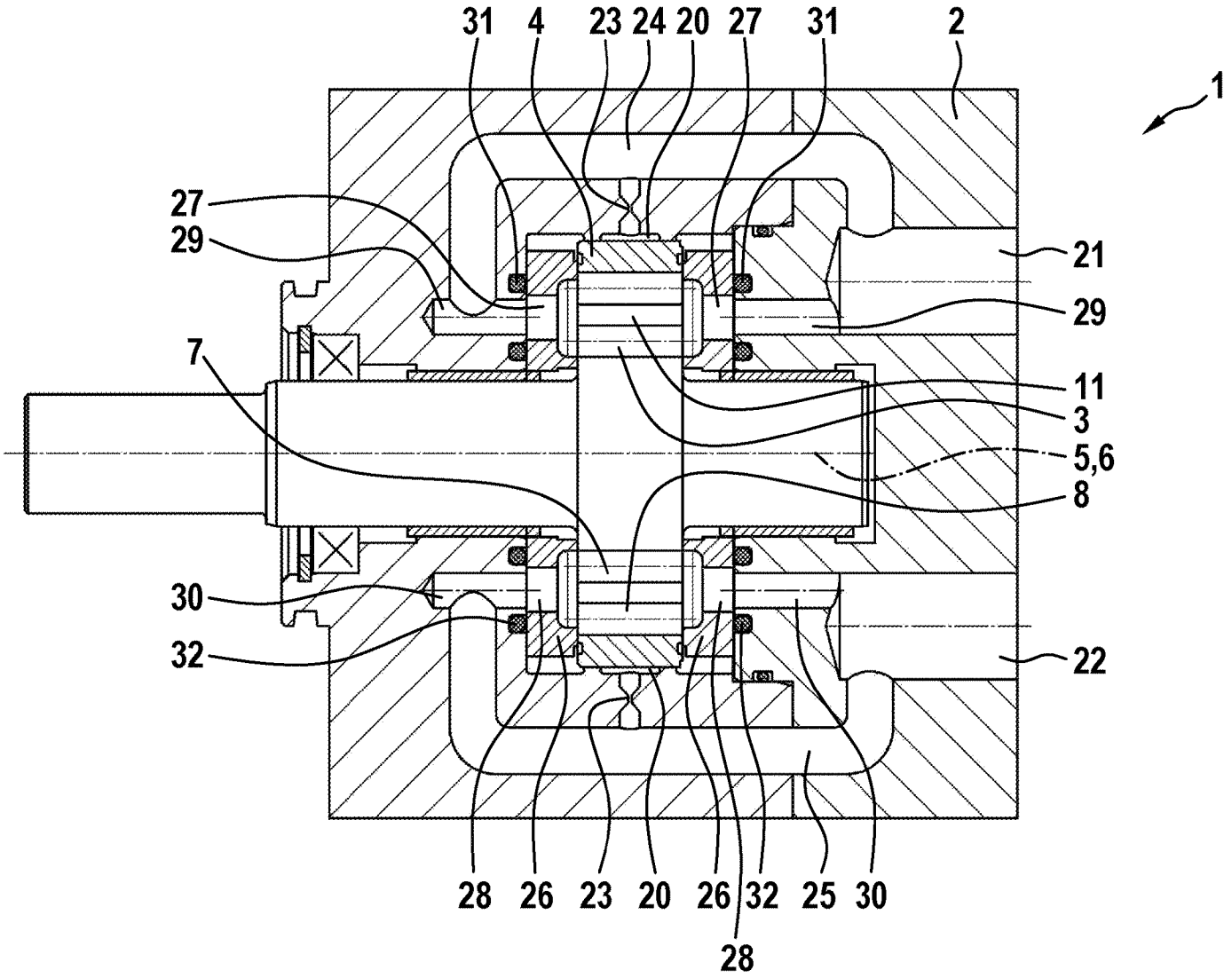
Figure 3:
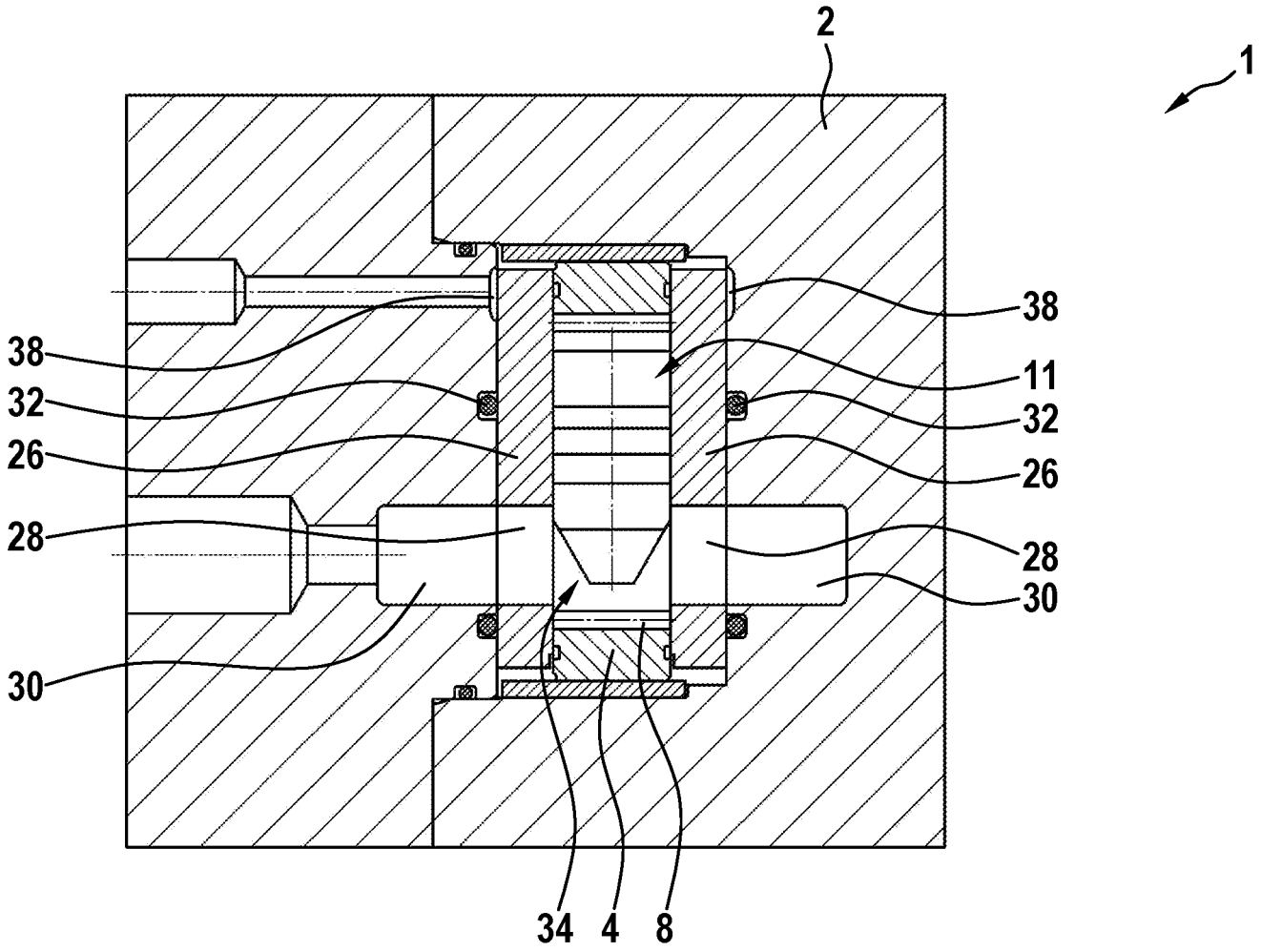
Figure 5:
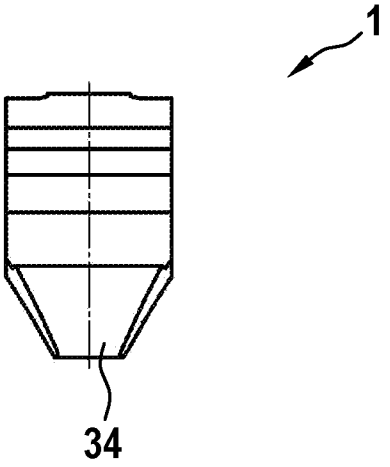
Figure 4:
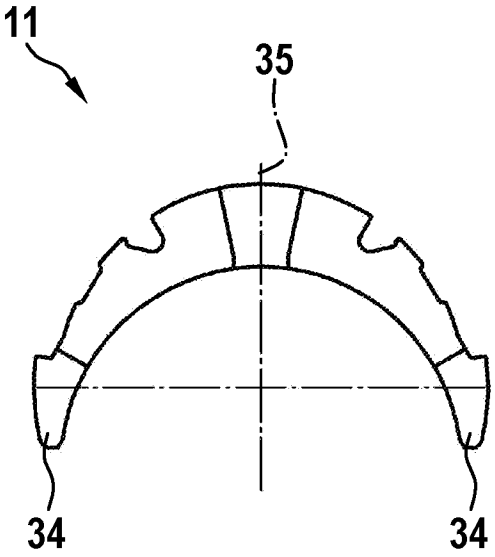

The invention is explained below with reference to the embodiments shown in the drawing, without any limitation of the invention. Thereby shows:

FIG. 1 a schematic cross-sectional view of an internal gear fluid machine,

FIG. 2 a schematic longitudinal sectional view of the internal gear fluid machine, FIG. 3 another schematic longitudinal sectional view of the internal gear fluid machine, FIG. 4 a first detailed view of a filler piece of the internal gear fluid machine, and FIG. 5 another schematic detailed view of the filler piece.

FIG. 1 shows a schematic cross-sectional view of an internal gear fluid machine 1, which has a machine housing 2 in which a first gearwheel 3 and a second gearwheel 4 are rotatably mounted. The first gearwheel 3 can also be referred to as a pinion and the second gearwheel 4 as a ring gear. The first gearwheel 3 is rotatably mounted about a first axis of rotation 5 and the second gearwheel 4 is rotatably mounted about a second axis of rotation 6 in the machine housing 2. It can be seen that the first axis of rotation 5 and the second axis of rotation 6 are arranged parallel to and spaced apart from each other, so that the first gearwheel 3 and the second gearwheel 4 therefore have different axes of rotation. The first gearwheel 3 has an external toothing 7 and the second gearwheel 4 has an internal toothing 8, which mesh with each other in an engagement region 9, i.e. are in engagement with each other.

The first gearwheel 3 and the second gearwheel 4 together delimit a fluid chamber 10. The first gearwheel 3 delimits the fluid chamber 10 in a radially inward direction and the second gearwheel 4 in a radially outward direction. The fluid chamber 10 is divided into a first fluid chamber 12 and a second fluid chamber 13 in the circumferential direction by the meshing of the gearwheels 3 and 4 on the one hand and a filler piece 11 on the other. Depending on the direction of rotation of the internal gear fluid machine 1, one of the fluid chambers 12 and 13 is a suction chamber and another of the fluid chambers 12 and 13 is a pressure chamber.

In the embodiment shown here, the filler piece 11 is symmetrical in order to enable reversing operation of the internal gear fluid machine 1. The internal gear fluid machine 1 can thus be operated in both directions of rotation. In addition or alternatively, the filler piece 11 is designed in several parts and has several segments 14 and 15 or 16 and 17. The segments 14 and 15 or 16 and 17 are subdivided in the radial direction. Accordingly, the first segment 14 or 16 is in contact with the first gearwheel 3 and the second segment 15 or 17 is in contact with the second gearwheel 4.

There is a gap 18 or 19 between the segments 14 and 15 or 16 and 17, which can be pressurised with fluid. This fluid pressurisation forces the segments 14 and 15 or 16 and 17 in the direction of the respective gearwheel 3 or 4. This results in radial compensation of the internal gear fluid machine 1.

Furthermore, it can be seen that the second gearwheel 4 is surrounded in the circumferential direction at least in some areas, in particular only in some areas, by one or more bearing recesses 20. The bearing recesses 20 are fluidically connected to fluid connections 21 and 22 of the internal gear fluid machine 1 (not shown here), preferably in each case via a flow resistance 23. The flow connections between the respective bearing recess 20 and the fluid connections 21 and 22 can be established via a respective connecting channel 24 or 25. The bearing recesses 20 are designed in such a way that they are at least temporarily acted upon by pressurised fluid, for example from the fluid connections 21 and 22, so that they form a hydrostatic bearing for the second gearwheel 4.

It can be provided that one of the bearing recesses 20 is only fluidically connected to that of the fluid connections 21 and 22 which is assigned to a pressure side of the internal gear machine 1. This is particularly the case if the internal gear machine 1 is not reversible or is only operated in a preferred direction of rotation. However, if the internal gear machine 1 is designed for reversible operation and is operated with intermittently changing directions of rotation, the bearing recesses 20 are preferably fluidically connected to both fluid connections 21 and 22, namely one of the bearing recesses 20 to the fluid connection 21 and another of the bearing recesses 20 to the fluid connection 22. Thus, one of the bearing recesses 20 is always subjected to the pressure present on the pressure side of the internal gear fluid machine 1, whereas the other of the bearing recesses 20 is only subjected to the pressure present on the suction side, which is lower.

FIG. 2 shows a longitudinal sectional view of the internal gear fluid machine 1. It can be seen that the gearwheels 3 and 4 are mounted in the axial direction in the machine housing 3 by means of—purely optional—sealing discs 26. The sealing discs 26 are arranged on opposite sides of the gearwheels 3 and 4 and lie against them in a sealing manner during operation of the internal gear fluid machine 1. First axial openings 27 and second axial openings 28 are formed in the sealing discs 26. The axial openings 27 and 28 completely penetrate the respective sealing disc 26 in the axial direction.

It can be seen that the axial openings 27 and 28 each widen in the direction of the gearwheels 2 and 4. For example, the axial openings 27 and 28, seen in section, are aligned on their side facing the gearwheels 3 and 4 in the radial direction on the inside with a root circle of the external toothing 7 and/or in the radial direction on the outside with a root circle of the internal toothing 8, whereby only the former is shown here. At least the axial openings 27 and 28, seen in section, lie between the root circle of the external toothing 7 and the root circle of the internal toothing 8, i.e. do not project beyond them in the radial direction. This ensures a high efficiency of the internal gear fluid machine 1.

The axial openings 27 are arranged on both sides of the first fluid chamber 12 and the second axial openings 28 on both sides of the second fluid chamber 13. The first fluid chamber 12 is fluidically connected to the first fluid connection 21 via the first axial openings 27. Similarly, the second fluid chamber 13 is fluidically connected to the second fluid connection 22 via the second axial openings 28. For this purpose, connection channels 29 and 30 are formed in the machine housing 2. The first axial openings 27 are connected to the respective fluid connections 21 and 22 via the connection channels 29 and the second axial openings 28 via the second connection channels 30. The sealing discs 26 and the axial openings 27 formed in them can be omitted. In this case, there is a direct flow connection between the connection channels 29 and 30 and the fluid chambers 12 and 13. Of course, only one of the sealing discs 26 can be implemented.

In the embodiment example shown here, one of the connecting channels 29 opens directly into the corresponding fluid connection 21 or 22, whereas the other of the connecting channels 29 and 30 is connected to the corresponding fluid connection 22 via the respective connecting channel 24 or 25. The connecting channels 24 and 25 completely overlap the gearwheels 3 and 4 and the sealing discs 26 in the axial direction.

As shown here, it can be provided that the first connection channels 29 open into the respective fluid connection 21 or 22 in the axial direction and the connection channels 24 and 25 open into the respective fluid connection 22 in the radial direction. The axial openings 27 and 28 are each surrounded by a seal 31 or 32, which ensures a fluid-tight connection of the respective axial opening 27 or 28 to the respective connecting channel 29 or 30.

It can be seen that the axial discs 26 have common dimensions in the axial direction which correspond at least to the dimensions of the gearwheels 3 and 4 in the same direction. This achieves a particularly reliable bearing of the gearwheels 3 and 4 in the machine housing 2. In particular, tilting of the axial discs 26 and the resulting uneven sealing of the fluid chambers 12 and 13 is reliably prevented.

FIG. 3 shows a further longitudinal sectional view of the internal gear fluid machine 1. It is clear that the filler piece 11 extends in the circumferential direction as far as the axial openings 28 and ends in the region of the axial opening 28. The same applies, of course, analogously to the first axial opening 27. The same applies, of course, analogously to the first axial opening 27. The filler piece 11 has a taper 34 through which it tapers in the axial direction, on both sides in the embodiment example shown here. The taper 34 is formed at the end of the filler piece 11 in the circumferential direction.

The taper 34 ends—also seen in the circumferential direction—in overlapping with the axial opening 28, so that the filler piece 11 in overlapping with the axial opening 28 has dimensions in the axial direction which correspond to the distance of the two sealing discs 26 from each other. Only when overlapping with the axial opening 28 does the filler piece 11 begin to taper in the direction of its free end. The taper 34 results in optimised flow guidance so that the fluid can flow unhindered into or out of the respective fluid chamber 12 or 13.

A pressure field is preferably formed away from the seal 32, which can be acted upon by pressurised fluid to apply a force directed in the direction of the gearwheels 3 and 4 to the sealing discs 26. For example, fluid is supplied to the pressure field from one of the fluid connections 21 and 22 or both fluid connections 21 and 22. A corresponding fluid connection can be realised for this purpose. The described design ensures that the fluid chambers 12 and 13 are reliably sealed in the axial direction by the sealing discs 26.

FIG. 4 shows a first detailed representation of the filler piece 11, which is symmetrical in the circumferential direction, i.e. it has at least one axis of symmetry 35 with respect to which it is mirror-symmetrical. A taper 34 is formed at each end of the filler piece in the circumferential direction. The filler piece 11 has an extension of at least 180° in the circumferential direction, preferably more than 180°, in particular at least 190°, at least 200°, at least 210° or at least 220°. In the embodiment example shown here, the extension in the circumferential direction is at least 225°. The described design of the filler piece 11 enables reversible operation of the internal gear fluid machine 1, i.e. operation with any direction of rotation. It also ensures reliable sealing of the fluid chambers 12 and 13 from each other in the circumferential direction.

FIG. 5 shows a further schematic representation of the filler piece 11, whereby the end taper 34 on both sides can once again be seen. This enables a particularly effective inflow of the fluid into the fluid chambers 12 and 13 or an outflow from them. Preferably, the filling piece has constant dimensions in the axial direction away from the taper 34 or the tapers 34.

FIGS. 1 and 4 also show a return flow 36, via which fluid, in particular leakage fluid, can be discharged from the internal gear fluid machine 1 and/or supplied again to the internal gear fluid machine 1 or the respective suction chamber. Viewed in the circumferential direction, the return 36 is arranged approximately centrally with respect to the filler piece 11, preferably exactly centrally. Particularly preferably, the return 36 is symmetrical with respect to an imaginary plane which contains both the first axis of rotation 5 and the second axis of rotation 6.

The return 36 has a return recess 37 which reaches through an inner circumferential surface of the machine housing 2 facing the second gearwheel 3, so that the return recess 37 is open in the direction of the gears 3 and 4. In addition, the return 36 has return pockets 38, which are preferably in flow connection with the return recess 37. While the return recess 37 overlaps the gearwheels 3 and 4 as seen in the axial direction, the return pockets 38 are located on both sides of the gearwheels 3 and 4 as seen in the axial direction, in particular they are formed on the sides of the sealing discs 26 in the machine housing 2 facing away from the gearwheels 3 and 4.

Via the return 36, i.e. via the return recess 37 and the return pockets 38, the fluid can be discharged and preferably fed to the respective suction chamber again. For example, the bearing recess 20 opens into the return recess 37. It may be provided that the bearing webs bounding the bearing recess 20 in the axial direction also bound the return recess 37 in the axial direction. Preferably, however, the bearing recesses 20 are spaced apart from the return recess 37 in the circumferential direction. Preferably, the bearing recesses are symmetrical with respect to the return recess 37, in particular they have the same distance to it.

In order to limit the amount of leakage fluid, the flow resistors 23 are provided. These are preferably identical in design and have, for example, a smallest diameter over their respective extension which, in relation to a displacement volume of the internal gear fluid machine 1, is at least 15 $l/m^2$ and at most 75 $l/m^2$. This makes it possible to achieve effective mounting of the second gearwheel 4 in the machine housing 2 and, at the same time, to significantly reduce the amount of leakage fluid. One of the flow resistors 23 is fluidically arranged between one of the bearing recesses 20 and the pressure side, and another of the flow resistors is fluidically arranged between another of the bearing recesses 20 and the suction side of the internal gear fluid machine. A fluidic connection between the bearing recesses 20 is preferably only present via unavoidable leakages and/or via the internal gear fluid machine 1 itself, i.e. via the fluid chamber 10 or at least one or both of the fluid chambers 12 and 13.

The described design of the internal gear fluid machine 1 enables particularly efficient fluid guidance and a high fluid throughput. In addition, it can be operated reversibly due to the symmetrical design of the filling piece 11. Since the filling piece 11 is made up of several parts, a four-segment internal gear fluid machine is realised, which ensures effective sealing of the fluid chambers 12 and 13 from each other in any direction of rotation in the circumferential direction by means of the filler piece 11.

The invention claimed is:

1. An internal gear fluid machine comprising:

a first gearwheel having an external toothing and mounted rotatably about a first axis of rotation, and a second gearwheel having an internal toothing meshing in regions with the external toothing in an engagement region and mounted rotatably about a second axis of rotation different from the first axis of rotation;

a filler piece arranged between the first gearwheel and the second gearwheel away from the engagement region, the filler piece bearing on a first side against the external toothing and bearing on a second side against the internal toothing in order to divide a fluid space present between the first gearwheel and the second gearwheel into a first fluid chamber and a second fluid chamber;

a connection channel formed in each of two housing walls of a machine housing of the internal gear fluid machine, the housing walls arranged in an axial direction with respect to the first axis of rotation on both sides of the first gearwheel and the second gearwheel; and at least one sealing disc arranged in the axial direction with respect to the first axis of rotation next to the first gearwheel and the second gearwheel, which, during operation of the internal gear fluid machine, bears in a sealing manner against the first gearwheel and the second gearwheel, an axial opening being formed in the sealing disc, via which one of the fluid chamber is in flow communication with one of the fluid connections of the internal gear fluid machine, wherein at least one of the first and second fluid chambers are in flow connection with the internal gear fluid machine via both of the connection channels, wherein the filler piece is tapered in the axial direction in overlapping with the axial opening.

2. The internal gear fluid machine according to claim 1, wherein at least one of the connection channels is fluidically connected to the fluid chamber via the axial opening.

3. The internal gear fluid machine according to claim 1, wherein the axial opening widens in a direction of the first gearwheel and the second gearwheel.

4. The internal gear fluid machine according to claim 1, wherein a first connection channel of the connection channels is connected directly and a second connection channel of the connection channels is connected fluidically to the fluid connection via a further connection channel which overlaps the first gearwheel and the second gearwheel in the axial direction.

5. The internal gear fluid machine according to claim 1, wherein that the axial opening is surrounded by a seal, which bears sealingly on the sealing disc and on the machine housing, wherein a pressure field fluidically connected to a pressure side of the internal gear fluid machine is formed outside a region surrounded by the seal, so that the sealing disc is at least temporarily urged in a direction of the gearwheels.

6. The internal gear fluid machine according to claim 1, wherein the filler piece projects in a circumferential direction as far as the axial opening and/or, viewed in the circumferential direction, ends in overlap with the axial opening.

7. The internal gear fluid machine according to claim 1 the taper of the filler piece, viewed in a circumferential direction, ends in overlap with the axial opening.

8. The internal gear fluid machine according to claim 1, wherein the second gearwheel is surrounded in a circumferential direction at least in regions by at least one bearing recess which is formed in the machine housing and which in the axial direction only partially engages over the second gearwheel and is fluidically connected to one of the fluid connections.

9. The internal gear fluid machine according to claim 1, wherein the fluid connection is a first fluid connection of a plurality of fluid connections and the first fluid chamber is in flow connection with the fluid connection present as the first fluid connection via the connection channels present as first connection channels, and in that a second connection channel is formed in each of the housing walls and the second fluid chamber is in flow connection with a second fluid connection of the internal gear fluid machine via the second connection channels.

10. The internal gear fluid machine according to claim 1, wherein the filler piece is symmetrical in a circumferential direction so that the internal gear fluid machine is reversible.

* * * * *